US006125759A

United States Patent [19]

Epps

[11] Patent Number: 6,125,759

[45] Date of Patent: Oct. 3, 2000

[54] PRINTING PRESS WITH INFRARED DRYER SAFETY SYSTEM

[75] Inventor: Michael Van Epps, Oak Park, Ill.

[73] Assignee: Oxy-Dry Corporation, Itasca, Ill.

[21] Appl. No.: 09/235,087

[22] Filed: Jan. 21, 1999

Related U.S. Application Data

[63] Continuation-in-part of application No. 08/967,394, Nov. 11, 1997.

[51] Int. Cl.[7] ..... B41F 1/60

[52] U.S. Cl. ..... 101/484; 101/483

[58] Field of Search ..... 101/484, 483, 101/488, 487, 424.1; 34/269, 273

[56] References Cited

U.S. PATENT DOCUMENTS

| | | | |
|---|---|---|---|
| 3,249,741 | 5/1966 | Mills | 101/424.1 |
| 3,753,466 | 8/1973 | Uematsu | 169/2 |
| 4,168,903 | 9/1979 | Tolmie | 355/3 |
| 4,408,400 | 10/1983 | Colapinto | 34/4 |
| 4,501,072 | 2/1985 | Jacobi, Jr. et al. | 34/1 |
| 4,798,007 | 1/1989 | Eichenlaub | 34/4 |
| 4,809,608 | 3/1989 | Wolnick et al. | 101/416.1 |
| 4,841,903 | 6/1989 | Bird | 118/46 |
| 4,939,992 | 7/1990 | Bird | 101/183 |
| 5,132,519 | 7/1992 | Jackson et al. | 211/388 |
| 5,317,127 | 5/1994 | Brewster, Jr. et al. | 219/388 |
| 5,323,485 | 6/1994 | Josefsson et al. | 392/417 |
| 5,369,894 | 12/1994 | Schaffer et al. | 34/268 |
| 5,383,403 | 1/1995 | Nordvall | 101/424.1 |
| 5,440,821 | 8/1995 | Hamrin | 34/267 |
| 5,496,406 | 3/1996 | Beisswanger et al. | 118/643 |
| 5,537,925 | 7/1996 | Secor et al. | 101/424.1 |
| 5,727,472 | 3/1998 | Burgio | 101/487 |
| 5,832,833 | 11/1998 | Burgio | 101/424.1 |
| 5,937,535 | 8/1999 | Hoffman et al. | 34/78 |
| 5,937,761 | 8/1999 | Buschmann et al. | 101/487 |

*Primary Examiner*—John S. Hilten
*Assistant Examiner*—Anthony H. Nguyen
*Attorney, Agent, or Firm*—Leydig, Voit & Mayer, Ltd.

[57] ABSTRACT

A printing press having an infrared dryer is provided. The infrared dryer has a safety system which includes a temperature sensor arranged to monitor the temperature in the vicinity of the infrared dryer and an actuatable protective measure or device such as, for example, a warning signal, a fire extinguishing system and/or a shut-down of the printing press. The actuatable protective measure being in communication with the temperature sensor such that when the temperature sensor senses a temperature which exceeds a predetermined value, the protective device is actuated.

23 Claims, 5 Drawing Sheets

PRINTING PRESS WITH INFRARED DRYER SAFETY SYSTEM

RELATED APPLICATION

This application is a continuation-in-part of U.S. application Ser. No. 08/967,394 filed Nov. 11, 1997, said application being incorporated herein by reference.

FIELD OF THE INVENTION

This invention generally relates to drying liquid printing substances such as inks, coatings and the like applied to sheet material in a printing press, and, more particularly, to an infrared printing press dryer having a safety system.

BACKGROUND OF THE INVENTION

One of the major concerns associated with the use of printing systems having infrared dryers is the high operating temperatures of such infrared dryers, which can be on the order of 800–1000° F. In particular, if the area in the vicinity of an infrared dryer is allowed to become too hot it can lead to warping or other damage to the printing system equipment. In some instances, such an excess temperature condition can be the result of simply running the infrared dryers at too high a temperature. In that case, if the operator is made aware of the problem, he can correct it by simply reducing the power supplied to the infrared lamps.

However, an excess temperature condition in the vicinity of the infrared dryers can also be an indication of a more serious problem. More specifically, if the boards, sheets or other printing substrate material become jammed in the area of the infrared dryer, the heat produced by the infrared dryer can ignite the substrate material and potentially can develop into a fire that jeopardizes not only the printing equipment, but also the safety of personnel in the area and even the plant in which the printing system is located. A build-up of dust and/or lint in the area of the infrared dryer can also create a potential fire hazard because of the high operating temperature of the dryer. These fire hazards can be compounded if the printing system continues to operate, and in particular, if the system continues to feed air to the area of the infrared dryer thereby fueling any fire, once an excess temperature condition is encountered.

OBJECTS AND SUMMARY OF THE INVENTION

Accordingly, in view of the foregoing, a general object of the present invention is to provide a printing press with one or more infrared dryer units having a safety system which effectively guards against the fire hazards associated with the high operating temperatures of the infrared dryers.

A more specific object of the present invention is to provide an infrared printing press dryer having a temperature responsive safety system which can prevent fire hazards caused by the interruption of the flow in the substrate material and/or a build-up of dust in the vicinity of the infrared dryer.

A further object of the invention is to provide an infrared printing press dryer having a safety system operable to sound an alarm and/or shut down the printing press when the temperature in the vicinity of the infrared dryer exceeds a predetermined value.

Yet another object of the invention is to provide an infrared printing press dryer having a temperature responsive safety system operable to reduce or stop the flow of air to the area around the infrared dryer when the temperature in the vicinity of the infrared dryer exceeds a predetermined value.

A further object of the present invention is to provide infrared printing press dryer having a temperature responsive safety system operable to release a fire retardant or extinguishing agent when the temperature in the vicinity of the infrared dryer exceeds a predetermined value.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
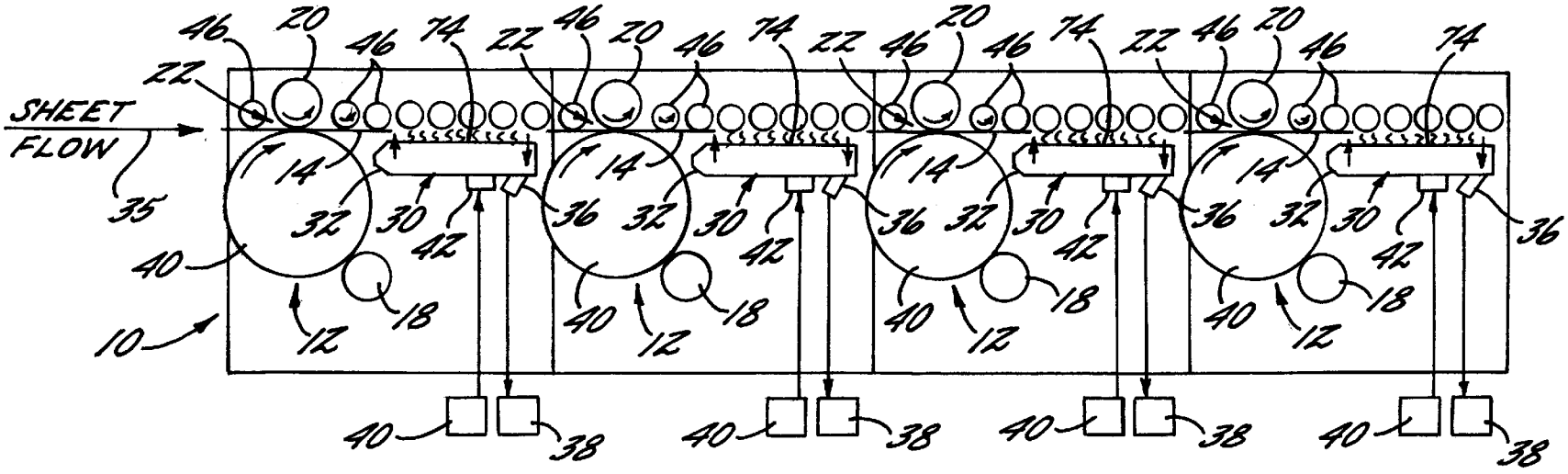
FIG. 1 is a schematic side elevation view of an illustrative in-line printing press with a plurality of laterally spaced printing units and interstation infrared dryers having respective safety systems in accordance with the present invention.

Referring now more particularly to FIG. 1 of the drawings, there is shown an illustrative printing press 10 embodying the present invention which, in this case, is an in-line printing press having a plurality of laterally spaced printing units 12 wherein a liquid printing substance, such as an ink, a coating, or the like, is applied to sheets or substrates 14 of printable material, such as paper, cardboard blanks, and the like. As is customary in the art, each printing station 12 includes a rotary plate cylinder 16 to which a printing plate is attached, a metering roller 18 which supplies either a specific color of ink or a coating to the plate cylinder 16, and a impression cylinder 20 which cooperates with the plate cylinder 16 to form a nip 22 therebetween. As sheets 14 pass between the upper impression cylinder 20 and the lower plate cylinder 16 of one of the printing units 12, the plate cylinder applies an inked image onto the sheets 14. In multicolor printing operations, a different color ink is applied to the sheets 14 at each printing unit or station 12.

To quickly and efficiently dry and bond the inks, coatings, and the like on the sheets or substrates 14, even during high-speed operation of the printing press 10, interstation dryer units 30 are interposed between the printing units 12. Each of the interstation dryer units 30 includes a plurality of infrared heating/drying elements 34 for transmitting infrared (IR) radiation to the moving printed sheets 14. To this end, each interstation dryer unit 30 comprises a relatively compact housing or cabinet 32 which supports the infrared elements 34 in relatively close proximity to the moving printed sheets 14. To further facilitate the drying process, the infrared elements 34 may comprise an alternating series of shortwave and mediumwave infrared lamps which are arranged at an angle to the sheet flow direction 35 as described in U.S. application Ser. No. 08/967,394. While the present invention is described in connection with an in-line printing press having interstation infrared dryer units interposed between a plurality of printing units, it will be readily appreciated that the invention is equally applicable to any type of printing press or system which includes an infrared dryer.

During the heating and drying of liquid printing substances on the passing printed sheets 14, a significant amount of moisture evaporates causing humidity to build-up between the printing units 12. In order to evacuate this moisture-laden air, the dryer cabinet 32 includes at least one exhaust port 36 which is coupled to and communicates with an exhaust or suction blower 38, as shown in FIG. 1. A continuous supply of relatively dehydrated replacement or make-up air from an inlet or supply blower 40 is directed into the interior of the dryer cabinet 32 via an inlet port 42.

Figure 2:
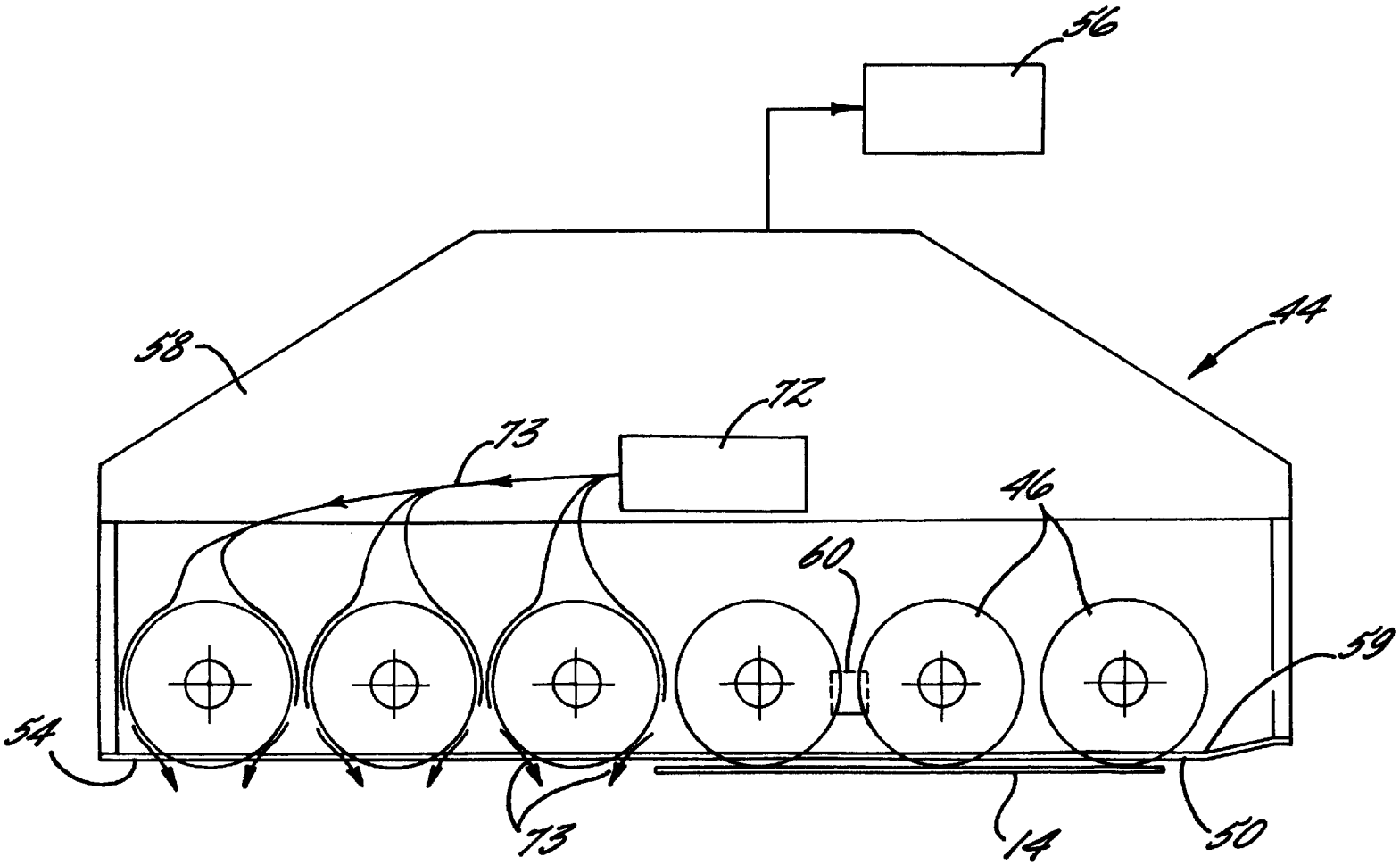
FIG. 2 is an enlarged schematic side elevation view of the sheet transfer system associated with one of the interstation infrared dryers of the illustrative printing press showing a temperature sensor and a fire extinguishing system.
Figure 3:
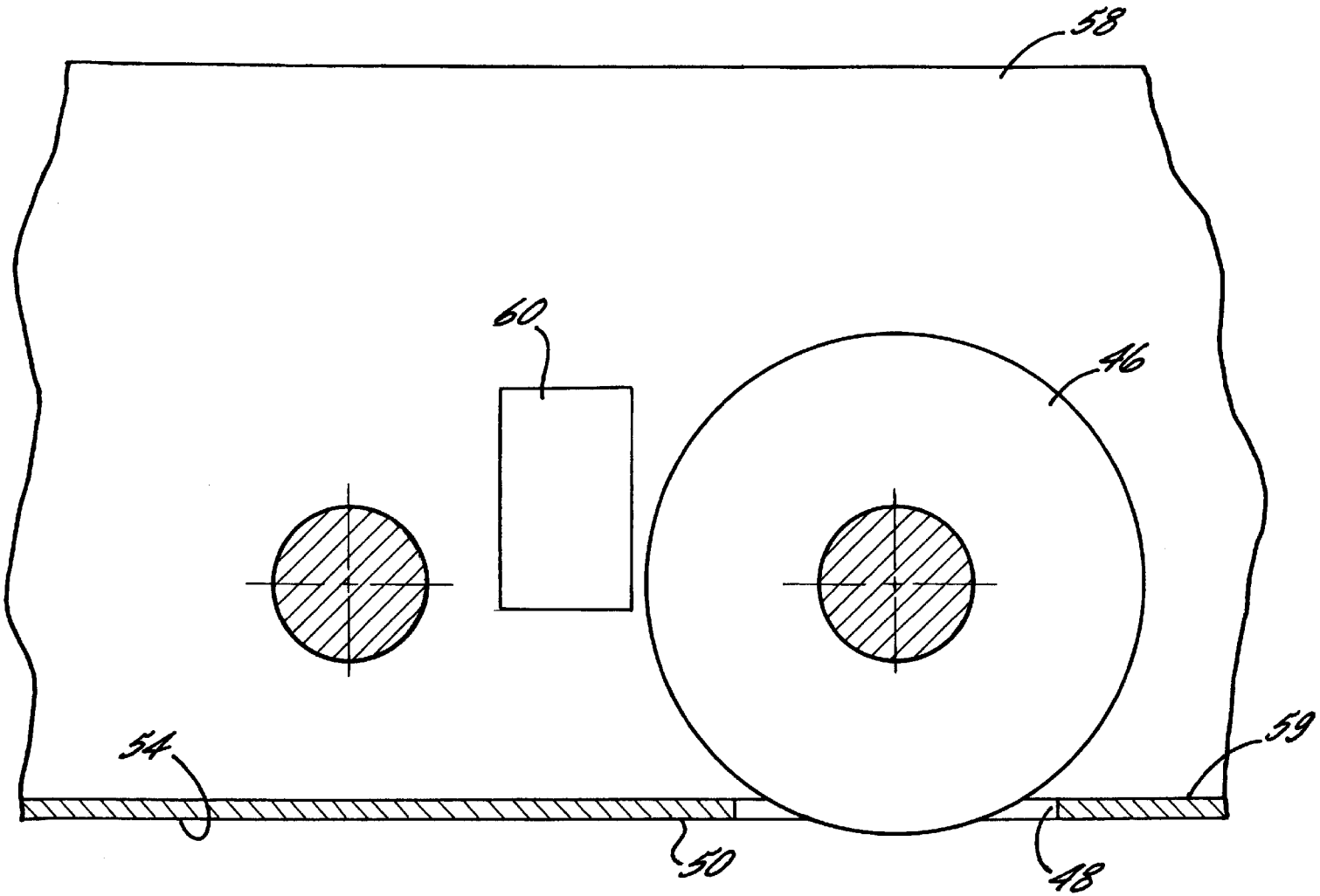
FIG. 3 is an enlarged side elevation view of the sheet transfer system of one of the interstation infrared dryers showing an exemplary arrangement of a temperature sensor.
Figure 4:
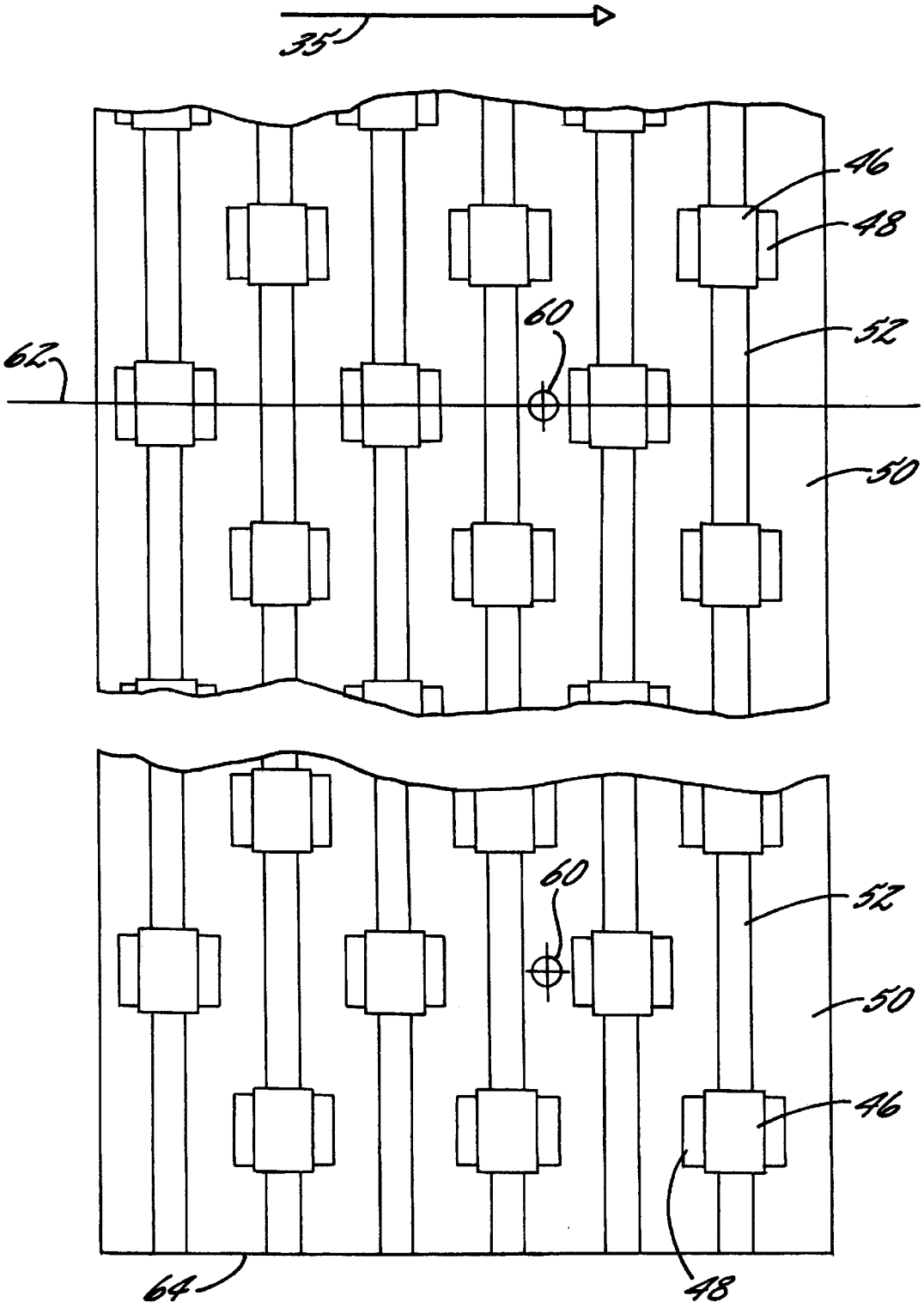
FIG. 4 is an enlarged partially cut away top plan view of the sheet transfer plate of one of the interstation infrared dryers showing an exemplary arrangement of two temperature sensors.

For transferring and guiding the sheets 14 as they move between the printing units 12 and through the infrared dryer units 30, the printing press 10 also includes a sheet transfer system 44. In the illustrated embodiment, the sheet transfer system 44 includes a plurality of aligned transfer rollers 46 which are arranged above the infrared dryer units 30 as shown in FIG. 1. As shown in FIGS. 2–4, a lower portion of each transfer roller 46 extends through a respective opening 48 in a transfer plate 50 which is arranged above the infrared dryer units 30 and below the shafts 52 (FIG. 4) which define the rotational axes of the respective transfer rollers. As is known and customary in the art, when the sheets 14 are traveling between printing units 12 and no longer supported by one of the plate cylinders 16, the sheets are maintained in contact with the transfer plate 50 and transfer rollers 46 by a vacuum applied from above and thereby through the openings 48 in the transfer plate 50. The vacuum maintains the sheets 22 in frictional contact with the transfer rollers 46 and the lower surface 54 of the transfer plate 50 such that the transfer plate defines a sheet-guiding path while rotation of the transfer rollers 46 moves the sheets 14 in the sheet-guiding direction 35 through the dryer unit 30 and towards the next downstream printing unit 12. In the illustrated embodiment, the vacuum source is an exhaust or vacuum blower 56 which communicates with the sheet transfer housing 58 and the upper surface 59 of the transfer plate 50 as shown schematically in FIG. 2. Those skilled in the art will appreciate that other types of exhaust or vacuum systems as well as sheet transfer systems may be utilized.

In accordance with one important aspect of the present invention, the infrared dryer units 30 are equipped with respective safety systems which are responsive to temperature and are operable to actuate one or more protective measures, devices and/or systems when the temperature in the vicinity of the passing substrate material 14 and/or the infrared dryer unit exceeds a predetermined value. Thus, the safety system for an individual infrared dryer unit 30 can be used to help prevent warping or other damage to the printing press 10 caused by a build-up of heat from the infrared elements 34 as well as to effectively guard against the fire hazards which can be associated with the use of infrared dryers. To this end, the safety system includes one or more temperature sensors 60 which are arranged in the printing press so as to monitor the temperature in the vicinity of the individual infrared dryer units 30 and the passing substrate or sheet material 14.

In the illustrated embodiment, a temperature sensor 60 is more specifically arranged in the printing press 10 so as to monitor the temperature of the transfer plate 50 in the area of each of the infrared dryers 30. As shown in FIGS. 2 and 3, the temperature sensor 60 for each dryer unit is disposed in the sheet transfer housing 58 a relatively short distance above the transfer plate 50, for example in one preferred embodiment approximately one foot above the transfer plate. The temperature sensor 60 comprises, in this instance, a non-contact infrared sensor which is arranged or directed so as to monitor the temperature of the transfer plate 50. One example of a suitable non-contact infrared temperature sensor is the temperature sensor sold by Watlow Gordon under the tradename IR JUNIOR (Model No. JRA1-0000-0000). Of course, those skilled in the art will appreciate that other types of temperature sensors can be used including contact-type sensors.

In order to ensure that the temperature monitored by the sensor is representative of the temperature in the area of the infrared dryer, it is preferable to arrange the sensor 60 along or close to the center line 62 of the transfer plate 50 as shown in FIG. 4. Moreover, when running sheet material 14 which has a width less than the entire width of the transfer plate 50, a portion of the transfer plate along one side edge 64 thereof can remain uncovered by the sheet material. In such instances, the area close to this side edge 64 of the transfer plate can be more susceptible to an excess temperature condition. Accordingly, it may be desirable to arrange a second temperature sensor 60, as shown in FIG. 4, close to this side edge 64 of the transfer plate. Those skilled in the art, however, will appreciate that the temperature sensor can be located in any location so long it is capable of monitoring the temperature in the vicinity of the infrared dryer.

To protect the printing press 10 against damage caused by excessive heat, as well as to afford protection against fire, the safety system is designed to actuate one or more protective measures or devices when the temperature sensor 60 senses a temperature above one or more predetermined values. For example, as shown in the block diagram of FIG. 5, in the illustrated embodiment, when the temperature sensor 60 senses a temperature in excess of a predetermined value (e.g., 280° F.), it sends a signal to a controller 68. The controller 68, in turn, actuates a warning light 70 on, for example, a control panel which is readily observable by an operator. This warning light informs the operator that the temperature in the area of the infrared dryer 30 is approaching the level at which the transfer plate 50 will warp or otherwise be damaged. If the operator does not adjust the infrared dryer 30 to a lower temperature or if the temperature continues to rise because of, for example, a fire, the illustrated safety system will, in this case, trigger a second alarm or warning light 70 when the temperature sensor 60 senses a temperature in excess of a second predetermined value (e.g., 300° F.).

In order to prevent sheet material 14 from continuing to be transported through the press in the event of a fire, thereby potentially spreading or adding fuel to the fire, the safety system can be configured to shut down the printing press 10 when the temperature in the vicinity of the infrared dryer 30 exceeds a predetermined value. In the case of the illustrated embodiment, when the temperature sensor 60 sends the signal to the controller 68 to actuate the second warning light 70, the controller also sends a signal to the printing press control system 71 to shut-down the entire printing press 10.

Figure 5:
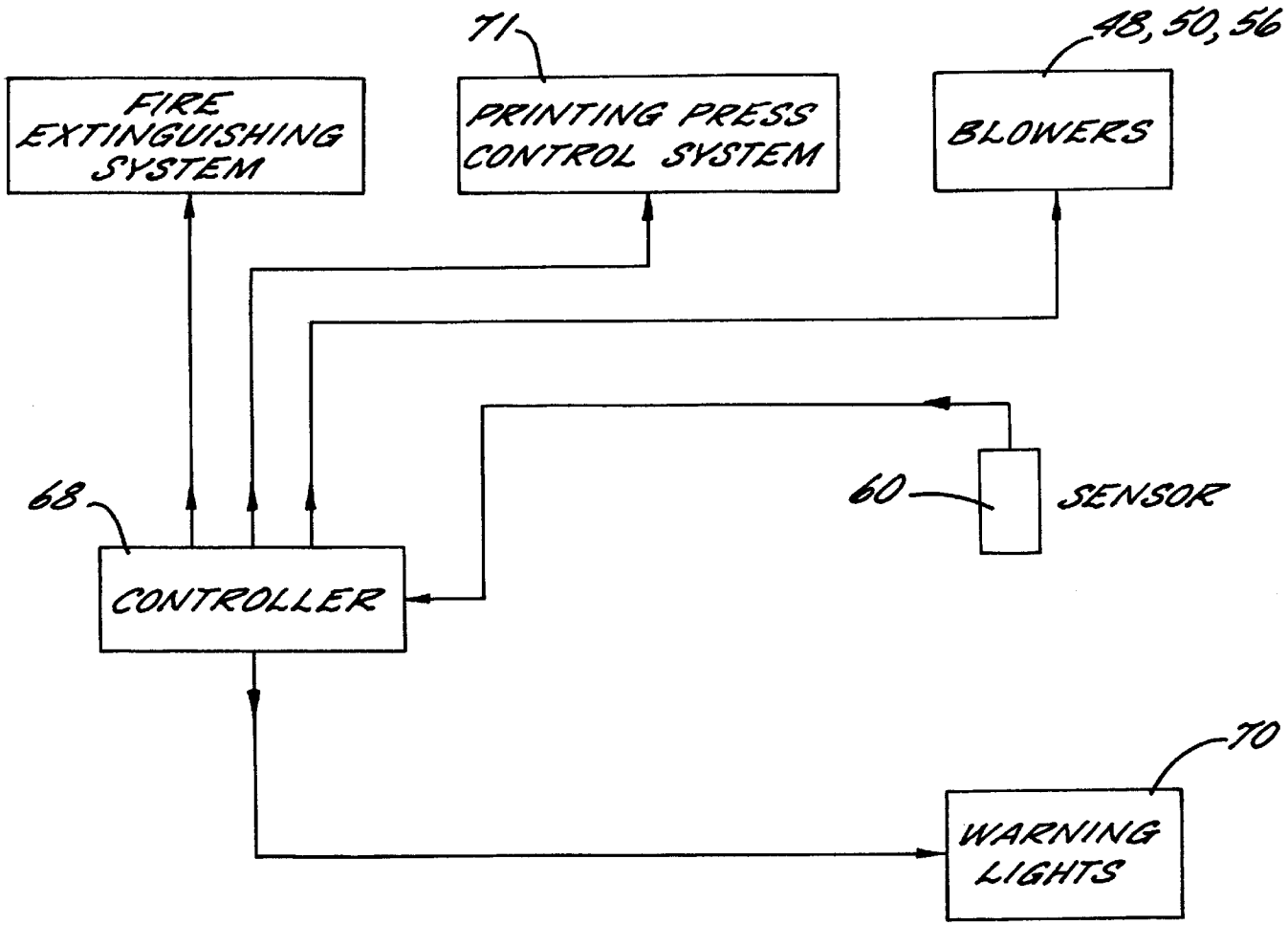
FIG. 5 is a block diagram showing one embodiment of a control system associated with the safety system of the present invention.

Additionally, to reduce the flow of air into the area around the infrared dryer 30, the safety system can also be configured to shut-down the blowers 56, 38, 40 associated with the sheet transfer system and infrared dryer unit when the temperature exceeds a predetermined value. In this case, as shown in FIG. 5, the controller 68 also sends a signal to shut down the blowers 38, 40, 56 upon receiving the signal from the temperature sensor 60 which actuates the second warning light.

To extinguish or retard the development of a fire in the area of one of the infrared dryer units, the safety system also can be configured to arm and/or fire a fire extinguishing system 72 when the temperature sensor 60 senses a temperature exceeding a predetermined value. In the illustrated embodiment, the fire extinguishing system 72 is located in the upper portion of the sheet vacuum transfer housing 58 as shown in FIG. 2. The fire extinguishing system 72, in this case, comprises a pressurized source of a flame retardant or extinguishing agent which discharges via nozzles into the area surrounding the infrared dryer unit 30 and the sheet transfer system 44. As shown by the arrows 73 in FIG. 2, arranging the fire extinguishing system 72 above the transfer plate 50 in the sheet transfer housing 58 enables the fire extinguishing material to disperse both above the transfer plate and, via the openings 48, below the transfer plate. In one exemplary embodiment, the fire extinguishing system 72 comprises two 15 lb. Flag Spaceman brand fire extinguishers (Model No. NAF S-111). However, as will be appreciated by those skilled in the art, any number of different types of conventional fire extinguishing systems can be used such as those utilizing carbon dioxide, halon gas and dry chemical extinguishing agent.

In this case, upon actuation of the second warning light, the controller 68 also sends a signal to the fire extinguishing system 72 which arms the system. The fire extinguishing system 72 can then be fired manually by an operator, for example, at a control panel. In order to allow personnel to clear the area, a timer can be used to provide a delay between manual actuation of the fire extinguishing system 72 and the actual discharge of the fire extinguishing agent. Moreover, it will be readily appreciated that the fire extinguishing system 72 can be configured to fire automatically when it receives a signal from the temperature sensor 60, in this case via the controller 68, that the temperature in the area of the infrared dryer exceeds a predetermined value.

To provide added protection against fire, a barrier 74 (FIG. 1) can be provided over the infrared elements 34. More specifically, a protective barrier 74 of a material which permits the passage of the infrared radiation, such as quartz glass, can be placed in the dryer cabinet 32 over the top of the infrared elements. Such a barrier prevents the sheet material 14 from coming in contact with the hot infrared elements, for example in the event of a failure of the sheet transfer system, and potentially igniting.

From the foregoing, it can be seen that a infrared printing press dryer which has a safety system capable of taking any number of different protective measures when the temperature in vicinity of the infrared dryer exceeds a predetermined value has been provided. Thus, the safety system protects not only the equipment from damage caused by excess heat or fire but also effectively guards against fires which could jeopardize personnel and the plant in which the printing press is located. Those skilled in the art will appreciate that while the illustrated embodiment of the safety system of the present invention is capable of taking several different protective measures, the safety system could be configured to perform only one or any combination of the protective measures described herein. Moreover, the safety system could be configured to perform any number of other similar protective measures such as, for example, sounding an alarm or signaling the fire department or a central alarm station.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A printing press having a safety system comprising:

a printing unit for applying a printing substance on a substrate material, an infrared dryer unit having at least one infrared element which transmits infrared radiation for drying the printing substance on the substrate material, a substrate material transfer system for moving substrate material through said printing unit and past said infrared dryer unit, said transfer system including a transfer plate which defines a guide path in a substrate material flow direction for guiding movement of said substrate material past said infrared dryer unit, a temperature sensor arranged to monitor the temperature of said transfer plate, and a device in communication with the temperature sensor and responsive to the temperature sensor sensing a temperature of the transfer plate which exceeds a predetermined value for providing an indication thereof.

2. The printing press of claim 1 in which said temperature responsive device is a protective device actuatable in response to said temperature sensor sensing a temperature of a transfer plate which exceeds said predetermined value.

3. The printing press according to claim 2 wherein the protective device includes a fire extinguishing system arranged to discharge a fire extinguishing agent into an area above the infrared dryer unit.

4. The printing press according to claim 1 wherein the temperature sensor is arranged for sensing the temperature of said transfer plate along a centerline of the transfer plate which extends in the substrate flow direction.

5. The printing press according to claim 4 further including a second temperature sensor arranged for sensing the temperature of said transfer plate at a location adjacent a side edge of the transfer plate.

6. The printing press according to claim 1 wherein the temperature sensor is a non-contact infrared sensor mounted in spaced apart relation to said transfer plate.

7. The printing press according to claim 1 wherein the protective device is a warning light.

8. The printing press according to claim 1 wherein the protective device is an audible alarm.

9. The printing press according to claim 1 wherein the protective device is a controller which upon actuation shuts down operation of the printing press.

10. The printing press according to claim 1 wherein the printing press includes a plurality of printing units and the infrared dryer unit is interposed between a pair of the plurality of printing units and said transfer system moves said substrate material through said printing units and past said interposed dryer unit.

11. The printing press of claim 1 in which said substrate material transfer system moves said substrate material along a path between said dryer unit and temperature sensor.

12. The printing press of claim 1 in which said transfer plate includes a plurality of spaced apertures along the line of substrate material travel, and said substrate transfer system including a transfer roller associated with each transfer plate aperture for imparting movement to substrate material guided along said transfer plate.

13. The printing press of claim 1 in which said transfer plate is disposed between said infrared dryer unit and said temperature sensor.

14. The printing press of claim 13 in which said substrate material transfer system moves said substrate material along an underside of said transfer plate, said infrared dryer unit being disposed below said transfer plate, and said temperature sensor being disposed above said transfer plate.

15. A method for protecting from an excess temperature condition a printing press having an infrared dryer and a substrate material transfer system having a transfer plate for guiding movement of substrate material through said printing press and past said infrared dryer, the method comprising the steps of:

sensing the temperature of said transfer plate, and providing an indication when the sensed temperature of said transfer plate exceeds a predetermined value.

16. The method of claim 15 further including the step of shutting down the printing press when the sensed temperature exceeds said predetermined value.

17. The method of claim 15 wherein the wherein the printing press includes one or more blower systems operable to move air through the vicinity of the infrared dryer and further including the step of shutting down said one or more blower systems in response to said sensed temperature exceeding said predetermined value.

18. The method of claim 15 further including the step of discharging a fire extinguishing agent into the area surrounding the infrared dryer when said sensed temperature exceeds said predetermined value.

19. The method claim 15 further including the step of actuating a fire extinguishing system for the infrared dryer when the sensed temperature exceeds said predetermined value.

20. The method of claim 15 including sensing the temperature of said transfer plate at a point along a center line of the transfer plate in the direction of substrate material travel.

21. The method of claim 15 including sensing the temperature of said transfer plate by a non-contact sensor mounted in spaced relation to said transfer plate.

22. The method of claim 21 including sensing the temperature of said transfer plate by an infrared sensor.

23. The printing press according to claim 20 wherein the printing press includes a blower system operable to move air through the vicinity of the infrared dryer unit and wherein the protective device is a controller which upon actuation shuts down operation of said blower system.

* * * * *